US010413793B1

(12) United States Patent
Tong et al.

(10) Patent No.: US 10,413,793 B1
(45) Date of Patent: Sep. 17, 2019

(54) MODIFIABLE BOOMERANG

(71) Applicants: Kun Yuan Tong, Suwanee, GA (US); John Tong, Southlake, TX (US)

(72) Inventors: Kun Yuan Tong, Suwanee, GA (US); John Tong, Southlake, TX (US)

( * ) Notice: Subject to any disclaimer, the term of this patent is extended or adjusted under 35 U.S.C. 154(b) by 0 days.

(21) Appl. No.: 16/228,667

(22) Filed: Dec. 20, 2018

(51) Int. Cl.
*A63B 65/08* (2006.01)

(52) U.S. Cl.
CPC ..... *A63B 65/08* (2013.01); *A63B 2210/50* (2013.01)

(58) Field of Classification Search
CPC ..... A63B 65/08; A63B 2210/50
USPC ..... 473/590; 446/34
See application file for complete search history.

(56) References Cited

U.S. PATENT DOCUMENTS 692,608 A * 2/1902 Bristow ..... A63B 65/08 446/36
1,040,702 A * 10/1912 Lee ..... A63B 65/08 473/590
1,413,316 A * 4/1922 Bradley ..... A63H 33/185 446/34
2,361,988 A * 11/1944 Bonnifield ..... A63B 65/08 473/590
2,838,310 A * 6/1958 Redka ..... A63B 65/08 473/590
3,507,497 A * 4/1970 Gardner ..... A63B 65/08 30/347
3,565,434 A * 2/1971 Liston ..... A63B 65/08 273/DIG. 4
3,814,431 A * 6/1974 Callahan ..... A63B 65/08 446/36
3,860,203 A * 1/1975 Hyde ..... A63H 27/12 244/138 A
4,216,962 A * 8/1980 Flemming ..... A63B 65/08 473/590
4,817,961 A * 4/1989 Stone ..... A63B 65/08 473/590
5,413,354 A * 5/1995 Miller ..... A63B 65/08 446/36
5,868,596 A * 2/1999 Perthou ..... A63H 33/18 446/36
5,906,529 A * 5/1999 Spais ..... A63B 65/08 446/36
6,443,861 B1 * 9/2002 Foulke ..... A63B 65/08 446/46
10,020,772 B1 * 7/2018 Puri ..... H02S 20/00
2010/0248909 A1 * 9/2010 Thorpe ..... A63B 21/0023 482/91
2014/0038798 A1 * 2/2014 Littell ..... A63B 26/00 482/145
2017/0266481 A1 * 9/2017 Dalebout ..... A63B 21/4043
2017/0319905 A1 * 11/2017 O'Connor ..... A63B 24/0087

FOREIGN PATENT DOCUMENTS

AT 388871 B * 9/1989 ..... A63B 65/08
CA 712326 A * 6/1965
EP 0917891 A1 * 5/1999 ..... A63B 65/08
GB 188188 A * 11/1922 ..... A63B 65/08

* cited by examiner

*Primary Examiner* — Steven B Wong
(74) *Attorney, Agent, or Firm* — Wang Law Firm, Inc.

(57) ABSTRACT

A modifiable boomerang comprises of a pair of wing blades which have a curved top surface and a flat bottom surface. The wings are connected together by a pivot bolt to form a boomerang whose angle can be adjusted to change the aerodynamics of the flying boomerang. A thrower can change the angle of a boomerang to change its flying pattern.

2 Claims, 2 Drawing Sheets

3

MODIFIABLE BOOMERANG

THE BACKGROUND OF THE INVENTION

An ordinary boomerang has a fixed angle of its wings and its flying course and pattern are heavily influenced by this angle. If we change this angle then its flying course and pattern will change. The present invented modifiable boomerang has a hinge joint installed at its center to allow adjustment of its angle.

THE BRIEF DESCRIPTION OF THE INVENTION

Every boomerang has its wings set at a certain angle. Therefore, it has a certain flying pattern. When the angle of a boomerang changes its flying pattern will change also. The present invented modifiable boomerang is equipped with a hinge joint at the center to allow the thrower to change the angle of the boomerang and thus change the flying pattern of the boomerang.

DETAILED DESCRIPTION OF DRAWINGS

SPECIFICATION

Figure 1:
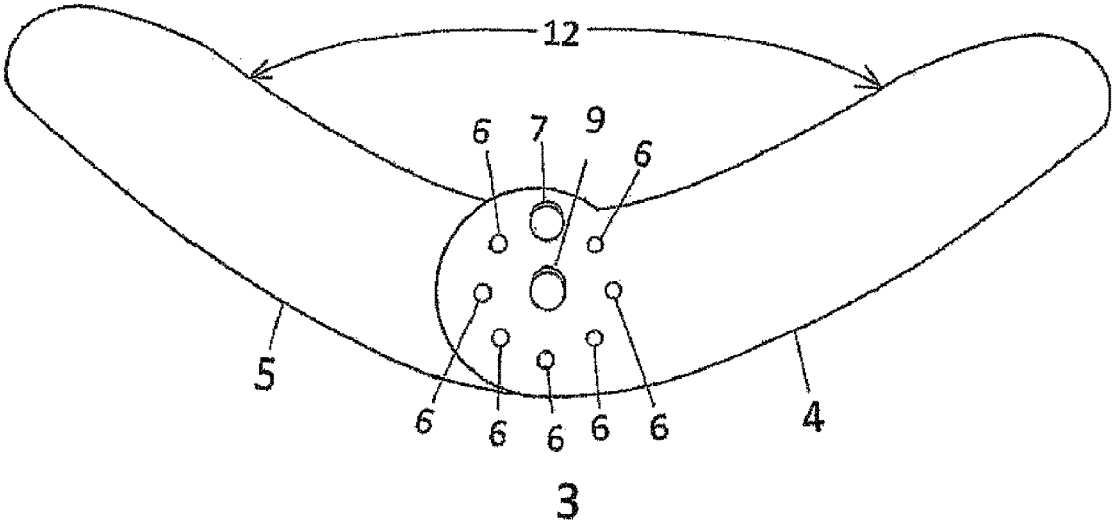
FIG. 1 is perspective view of a modifiable boomerang.

Referring now to the drawings in detail, numeral 3 of FIG. 1 is a modifiable boomerang.

Figure 2:
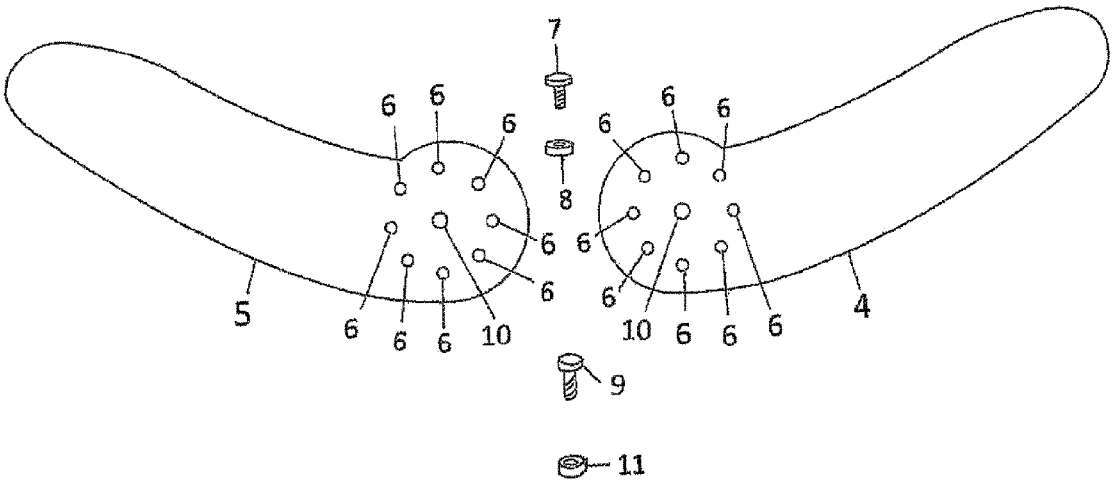
FIG. 2 is perspective view of components of modifiable boomerang.

Numeral 4 of FIGS. 1 and 2 is a top wing blade.

Numeral 5 of FIGS. 1 and 2 is a bottom wing blade.

The top wing blade 4 and bottom wing blade 5 have a top curved surface and a flat bottom surface.

Numeral 6 of FIGS. 1 and 2 are bolt holes.

Numeral 7 of FIGS. 1 and 2 is an adjustment bolt.

Numeral 8 of FIG. 2 is an adjustment nut corresponding to bolt 7.

Numeral 9 of FIG. 2 is a pivot bolt.

Numeral 10 of FIG. 2 is a pivot hole for the pivot bolt 9.

Numeral 11 of FIG. 2 is a pivot nut corresponding to pivot bolt 9. The pivot bolt 9 can pass snugly through pivot hole 10. The pivot nut 11 can screw snugly onto pivot bolt 9.

Numeral 12 of FIG. 1 is an angle made by the top wing blade 4 and bottom wing blade 5 of the modifiable boomerang 3.

The way to assemble the modifiable boomerang 3 is first to align the pivot hole 10 of the top wing blade 4 with the pivot hole 10 of the bottom wing blade 5 and then insert the pivot bolt 9 into the pivot hole 10 and screw on the pivot nut 11 tightly to make a modifiable boomerang 3. The angle 12 of the modifiable boomerang 3 can be set by first loosening the pivot nut 11, then aligning any bolt hole 6 of the top wing blade 4 with any bolt hole 6 of the bottom wing blade 5, then inserting bolt 7 through the bolt hole 6, then screwing on nut 8 tightly, and finally tightening the pivot nut 11. When the angle 12 is changed, the air dynamics of a thrown modifiable boomerang will be changed. Therefore a thrower can change the angle 12 of the modifiable boomerang 3 to change its flying pattern.

The invention claimed is:

1. A modifiable boomerang comprising:

two wing blades, each wing blade having a plurality of bolt holes arranged in a circular ring, each wing blade having a pivot hole located in a center of the circular ring of bolt holes, one pivot bolt with pivot nut, and one adjustment bolt with adjustment nut wherein said pivot bolt is fastened through the pivot hole and secured by the pivot nut and said adjustment bolt is fastened through one of the plurality of bolt holes on each wing blade and secured by the adjustment nut to fasten said wing blades into different angles to change said modifiable boomerang's flight pattern.

2. The modifiable boomerang of claim 1 wherein both wing blades have a curved top surface and a flat bottom surface.

* * * * *